US009836952B2

(12) United States Patent
Kushnir

(10) Patent No.: US 9,836,952 B2
(45) Date of Patent: Dec. 5, 2017

(54) ALARM CAUSALITY TEMPLATES FOR NETWORK FUNCTION VIRTUALIZATION

(71) Applicant: Alcatel-Lucent USA, Inc., Murray Hill, NJ (US)

(72) Inventor: Dan Kushnir, Springfield, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 0 days.

(21) Appl. No.: 15/092,369

(22) Filed: Apr. 6, 2016

(65) Prior Publication Data

US 2017/0294112 A1 Oct. 12, 2017

(51) Int. Cl.
*G08B 1/00* (2006.01)
*G08B 29/02* (2006.01)

(52) U.S. Cl.
CPC ..... *G08B 29/02* (2013.01)

(58) Field of Classification Search
CPC ..... G08B 29/02
USPC ..... 340/506, 507, 539.1, 539.11, 3.1
See application file for complete search history.

(56) References Cited

U.S. PATENT DOCUMENTS 5,400,246 A * 3/1995 Wilson ..... G08B 25/14 340/12.53
6,738,933 B2 5/2004 Fraenkel et al.

OTHER PUBLICATIONS

J. Sanchez, I. Grida Ben Yahia, and N. Crespi, "Self-modeling based diagnosis of software-defined networks," in Network Softwarization (NetSoft), 2015 1st IEEE Conference on, Apr. 2015, pp. 1-6.
R. Steinert, S. Gestrelius, and D. Gillblad, "A distributed spatio-temporal event correlation protocol for multi-layer virtual networks," in Global Telecommunications Conference (GLOBECOM 2011), 2011 IEEE, Dec. 2011, pp. 1-5.
K. Julisch, "Clustering intrusion detection alarms to support root cause analysis," ACM Trans. Inf. Syst. Secur., vol. 6, No. 4, pp. 443-471, 2003.
Causality correlation and root cause analysis, http://www.cisco.com/c/ en/us/td/docs/net mgmt/active network abstraction/3-6 sp2/fault/user/ guide/fmug/chp2.html, 2015.
Network function virtualization (nfv); esiliency requirements, http://www.etsi.org/deliver/etsi gs/NFV-REL/001099/001/01.01.0160/gs nfv-rel001v010101p.pdf, 2015.
"Ceilometer," http://docs.openstack.org/developer/ceilometer/, 2015.
"Open stack," http://www.openstack.org/, 2015.
https://www.openstack.org/summit/vancouver-2015/summit-videos/presentation/stabilizing-the-jenga-tower-scaling-out-ceilometer, 2015. [VIDEO].
"Ganglia," http://ganglia.sourceforge.net/, 2015.
(Continued)

*Primary Examiner* — Daryl Pope
(74) *Attorney, Agent, or Firm* — Davidson Sheehan LLP

(57) ABSTRACT

A processor accesses a plurality of time series of alarms of a plurality of alarm types that are produced by resources of a network function virtualization (NFV) system. The processor identifies clusters of the plurality of alarm types based on similarities between the plurality of time series and determine causal connections between alarm types in the clusters based on temporal proximity and ordering of the alarm types in the clusters. The processor then stores one or more causality templates representative of the causal connections in a memory.

21 Claims, 8 Drawing Sheets

(56) References Cited

OTHER PUBLICATIONS

K. Pearson, "Notes on regression and inheritance in the case of two parents," Royal Society of London, vol. 58, No. 4, pp. 240-242, 1895.

C. C. Aggarwal and C. K. Reddy, Eds., Data Clustering: Algorithms and Applications. CRC Press, 2014.[Online]. Available: http://www.charuaggarwal.net/clusterbook.pdf.

B. Heller, C. Scott, N. McKeown, S. Shenker, A. Wundsam, H. Zeng, S. Whitlock, V. Jeyakumar, N. Handigol, J. McCauley, K. Zarifis, and P. Kazemian, "Leveraging sdn layering to systematically troubleshoot networks," in ACM SIGCOMM Workshop, New York, NY, USA: ACM, 2013, pp. 37-42.

H. Birkholz and I. Sieverdingbeck, "Improving root cause failure analysis in virtual networks via the interconnected-asset ontology," in Proceedings of the Conference on Principles, Systems and Applications of IP Telecomm. New York, NY, USA: ACM, 2014, pp. 2:1-2:8.

M. Miyazawa, M. Hayashi, and R. Stadler, "vnmf: Distributed fault detection using clustering approach for network function virtualization," in IFIP/IEEE International Symposium on Integrated Network Manage-ment (IM), May 2015, pp. 640-645.

C. Luo, J. Lou, Q. Lin, Q. Fu, R. Ding, D. Zhang, and Z. Wang, "Correlating events with time series for incident diagnosis," in ACM SIGKDD. New York, NY, USA: ACM, 2014, pp. 1583-1592.

* cited by examiner

ALARM CAUSALITY TEMPLATES FOR NETWORK FUNCTION VIRTUALIZATION

BACKGROUND

Field of the Disclosure

The present disclosure relates generally to communication networks and, more particularly, to virtualization of network functions in communication networks.

Description of the Related Art

Network function virtualization (NFV) implements network functionality on top of a virtual infrastructure that is deployed over general-purpose servers. For example, an NFV architecture typically includes computing hardware such as processors or servers, storage hardware such as memory devices, and networking hardware to interconnect the computing and storage hardware. The computing, storage, and network hardware is virtualized to provide virtual computing, storage, and networking resources such as virtual machines that can run applications using instances of an operating system executing on the virtual machine. Virtual networks may also be created using virtual routers implemented with the virtual computing and network resources. The virtual resources may be used to implement virtual network functions such as routing, load-balancing, firewalls, and the like. Virtual resources can use any combination of hardware and the hardware used to implement the virtual resources can change dynamically. Virtual functions are implemented using dynamically variable combinations of virtual resources and hardware. For example, a virtual router may only be deployed in response to creation of a corresponding virtual network and the virtual resources (as well as the corresponding hardware) used to implement the virtual router may change depending on the volume of traffic served by the virtual network. Virtual functions may also migrate among the available virtual resources or hardware. Since hardware and virtual resources are dynamically allocated, the NFV architecture allows for operational efficiencies such as dynamic creation of applications, service chaining, scaling, and healing.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Figure 1:
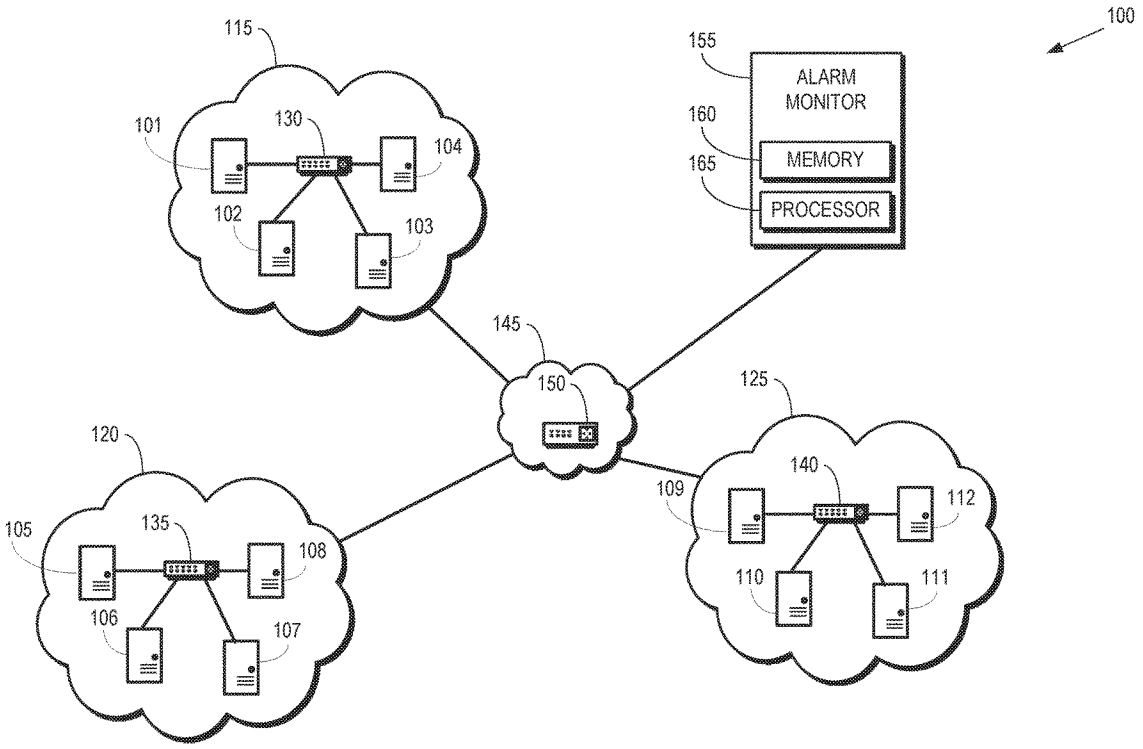
FIG. 1 illustrates a communication network that implements network function virtualization (NFV) according to some embodiments.

Failures or faults at any point in a network function virtualization (NFV) architecture can propagate to other layers of the NFV architecture. Alarms may therefore be generated by multiple virtual functions, virtual resources, or hardware resources in response to a single root cause. Identifying the root cause is complicated by the multi-vendor layered nature of the NFV architecture. For example, different vendors may provide the virtual functions, the virtual resources, or the hardware in the NFV architecture. One vendor may provide the hardware and may therefore define one set of alarms to indicate faults or failures in the hardware. Another vendor may provide the software to implement the virtual resources using the hardware and may therefore define another set of alarms to indicate faults or failures in the virtual resources. Yet another vendor may provide the software to implement virtual functions based on the virtual resources and may therefore define yet another set of alarms to indicate faults or failures in the virtual functions. Identifying the root cause of alarms produced across the different layers of the NFV architecture is therefore difficult.

The root causes of alarms produced in an NFV system may be identified on the basis of causality templates that are learned from past data that includes a set of time series of alarms of different alarm types that are produced by a plurality of resources in the NFV system. The resources include virtual functions, virtual resources, and corresponding hardware resources of the NFV system. Clusters of alarm types are defined using similarity measures such as correlating time series for the different alarm types and grouping the highly correlated alarm types into clusters. For example, the correlations of the different alarm types may be used to construct a graph in which each node represents an alarm type and edges between the nodes represent correlations. A weight associated with each edge indicates the strength of the correlation between the nodes connected by the edge. The clusters may then be defined based on the edges that have a weight that exceeds a threshold value.

Causal connections between the nodes in each cluster are determined based on temporal proximity and ordering of the alarms in the time series of the nodes. For example, if alarms of a first alarm type associated with a first node of a cluster have a temporal overlap with alarms of a second alarm type associated with a second node of the cluster, and if the alarms of the first alarm type are more likely to be activated before the alarms of the second alarm type, the second alarm type is determined to be caused by the first alarm type. The causal connections between the nodes may be represented as directed graphs in which the directions of the edges indicate the causal relation between the nodes that are connected by the edges. Logical relations between the alarm types may be determined based on the causal connections, e.g., a first alarm type may occur in response to a second alarm type and a third alarm type, whereas a fourth alarm type may occur in response to the second alarm type or the third alarm type. Root causes of an alarm (or set of alarms) may be determined in real-time by comparison with predetermined directed graphs representative of causal connections between alarm types. As used herein, the term "root cause" indicates a condition or event that results in an alarm, a set of alarms, a cascade of alarms, or any other monitored degradation event.

FIG. 1 illustrates a communication network 100 that implements network function virtualization (NFV) according to some embodiments. The communication network 100 includes hardware computing resources such as servers 101, 102, 103, 104, 105, 106, 107, 108, 109, 110, 111, 112 (collectively referred to herein as "the servers 101-112"), which may be implemented using processing units such as central processing units (CPUs), graphics processing units (GPUs), accelerated processing units (APUs), processor cores, compute units, application-specific integrated circuits (ASICs), field programmable gate arrays (FPGAs), and the like. Some embodiments of the servers 101-112 also include hardware storage resources such as memories (not shown in FIG. 1) for storing data or instructions that may be used by the servers 101-112, the results of operations performed by the servers 101-112, and the like.

The servers 101-112 may be partitioned into interconnected groups. For example, the servers 101-104 may be interconnected as part of an intranet 115, the servers 105-108 may be interconnected as part of an intranet 120, and the servers 109-112 may be interconnected as part of an intranet 125. The intranets 115, 120, 125 may be formed using hardware network resources 130, 135, 140 such as switches, routers, cables, optical fiber, and the like. The servers 101-112 in the intranets 115, 120, 125 may also be interconnected as part of a network 145 that may be formed using additional hardware network resources 150 such as switches, routers, cables, optical fiber, and the like.

The hardware computing, storage, and network resources in the communication network 100 may be used to implement an NFV architecture. For example, the hardware computing, storage, and network resources may be used to implement corresponding virtual computing, storage, and network resources, which may then be used to implement virtual network functions. As discussed herein, failures or faults in the hardware computing, storage, or network resources, the virtual computing, storage, or network resources, the virtual network functions, or any other point in the NFV architecture implemented by the communication network 100 can propagate to other layers of the NFV architecture. Alarms may therefore be generated by multiple virtual functions, virtual resources, or hardware resources in response to a single root cause.

The communication network 100 includes an alarm monitor 155 for monitoring alarms generated by hardware or virtual resources in the communication network 100. Some embodiments of the alarm monitor 155 include a processor 160 and a memory 165 for storing data or instructions. The processor 160 may execute instructions stored in the memory 165 and perform operations on the data stored in the memory 165. The processor 160 may also store the results of the executed instructions in the memory 165. The alarm monitor 155 can identify alarms in the communication network and categorize the alarms based on different alarm types. Examples of alarm types include "unable to acquire metrics," "high CPU load," "degraded virtual machine CPU performance," "high memory consumption," "degraded virtual machine memory performance," "storage alarm," "degraded virtual machine storage performance," CPU, memory, or virtual memory threshold violations, and the like.

Some embodiments of the processor 165 generate time series that indicate an activation time and a deactivation time for each alarm of a particular type. The time series may be stored in the memory 165. The processor 165 may then access the time series of alarms of different alarm types and identify clusters of the alarm types based on correlations between the alarms in the different time series. The processor 165 may then determine causal connections between alarm types in the clusters based on temporal proximity and ordering of the alarm types in the clusters. Causality templates that are representative of the causal connections may be stored in the memory 165 and later used for real-time identification of root causes of alarms in the communication network 100. In some embodiments, an additional phase shift may be applied to the alarms of one of the alarm types prior to identifying the clusters. The processor 165 may determine whether the time series of alarms of the first alarm type correlates with the phase-shifted times series of alarms of the second alarm type. The processor 165 may then check for overlap between the time series of alarms of the first alarm type and the phase-shifted time series of alarms of the second alarm type. If the processor 165 detects overlap, the processor 165 determines that a causal connection exists between the first and second alarm types.

Figure 2:
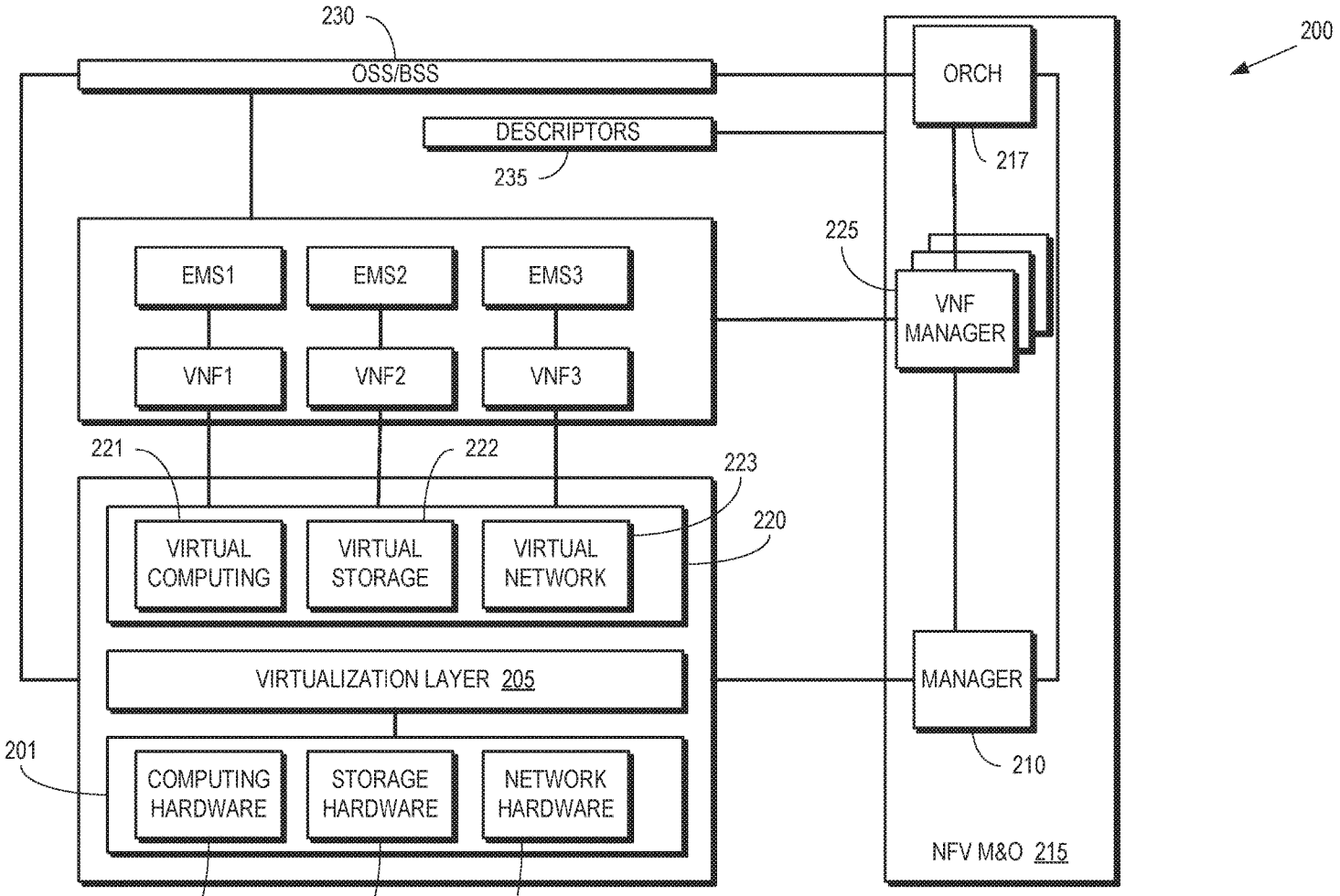
FIG. 2 is a block diagram of an NFV architecture according to some embodiments.

FIG. 2 is a block diagram of an NFV architecture 200 according to some embodiments. The NFV architecture 200 may be implemented in some embodiments of the communication network 100 shown in FIG. 1. The NFV architecture 200 includes hardware resources 201 including computing hardware 202, storage hardware 203, and network hardware 204. A virtualization layer 205 provides an abstract representation of the hardware resources 201. The abstract representation supported by the virtualization layer 205 can be managed using a virtualized infrastructure manager 210, which is part of the NFV management and orchestration (M&O) module 215. Some embodiments of the manager 210 are configured to collect and forward performance measurements and events that may occur in the NFV architecture 200. For example, performance measurements may be forwarded to an orchestrator (ORCH) 217 implemented in the NFV M&O 215. The hardware resources 201 and the virtualization layer 205 may be used to implement virtual resources 220 including virtual computing 221, virtual storage 222, and virtual networking 223.

Virtual networking functions (VNF1, VNF2, VNF3) run over the NFV infrastructure (e.g., the hardware resources 201) and utilize the virtual resources 220. For example the virtual networking functions (VNF1, VNF2, VNF3) may be implemented using virtual machines supported by the virtual computing resources 221, virtual memory supported by the virtual storage resources 222, or virtual networks supported by the virtual network resources 223. Element management systems (EMS1, EMS2, EMS3) are responsible for managing the virtual networking functions (VNF1, VNF2, VNF3). For example, the element management systems (EMS1, EMS2, EMS3) may be responsible for fault and performance management. In some embodiments, each of the virtual networking functions (VNF1, VNF2, VNF3) is controlled by a corresponding VNF manager 225 that exchanges information and coordinates actions with the manager 210 or the orchestrator 217.

The NFV architecture 200 may include an operation support system (OSS)/business support system (BSS) 230. The OSS/BSS 230 deals with network management including fault management using the OSS functionality. The OSS/BSS 230 also deals with customer and product management using the BSS functionality. Some embodiments of the NFV architecture 200 use a set of descriptors 235 for storing descriptions of services, virtual network functions, or infrastructure supported by the NFV architecture 200. Information in the descriptors 235 may be updated or modified by the NFV M&O 215.

Figure 3:
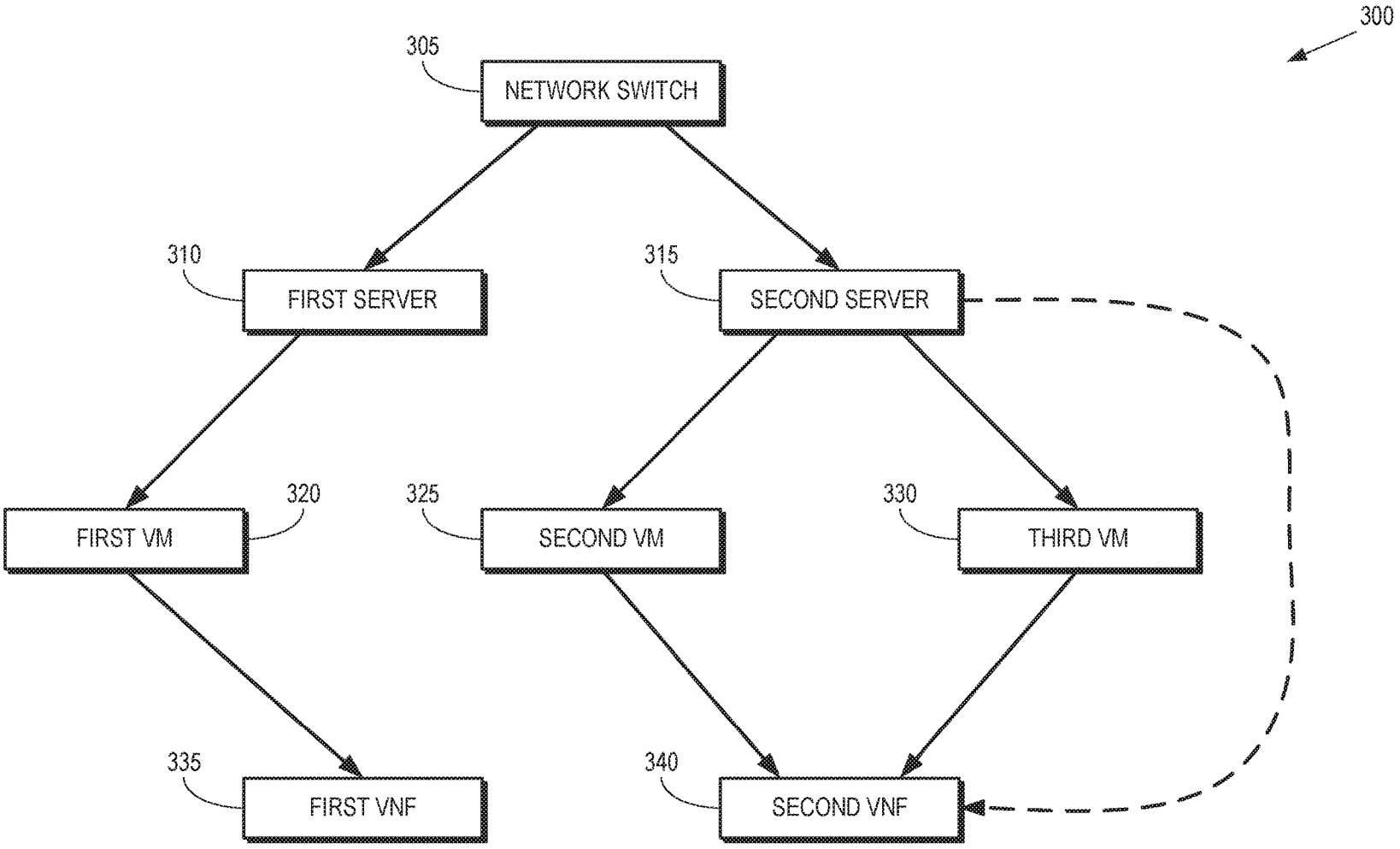
FIG. 3 is a block diagram of a cascade of errors generated by a root cause according to some embodiments.

FIG. 3 is a block diagram of a cascade of errors 300 generated by a root cause according to some embodiments. The cascade of errors may be produced in some embodiments of the communication network 100 shown in FIG. 1. In the illustrated embodiment, the root cause of the cascade of errors is an error in a hardware networking resource such as failure of a network switch 305. Hardware computing resources such as servers 310, 315 collect performance metrics such as connectivity related metrics and the failure of the network switch 305 causes these performance metrics to exceed a corresponding set of thresholds, which results in the servers 310, 315 generating additional alarms at the hardware layer.

A virtual machine 320 is running on the first server 310 and virtual machines 325, 330 are running on the second server 315. The virtual machines 320, 325, 330 may therefore raise additional alarms at the virtual resource layer in response to failure of the network switch 305 or the performance metrics exceeding their thresholds. The first virtual machine 320 supports a first virtual networking function 335. The first and second virtual machines 325, 330 support a second virtual networking function 340. The alarms may therefore propagate from the virtual machines 320, 325, 330 (or the servers 310, 315) to the virtual networking functions 335, 340, which may raise additional alarms. As discussed herein, the root cause of the cascade of errors 300 can be determined based on time series of alarms of different alarm types produced in response to the root cause. In some embodiments, dependency information such as information indicating the identities of the network switch 305, the servers 310, 315, the virtual machines 320, 325, 330, or the virtual networking functions 335, 340 together with their resource allocation (e.g., information indicating the server and virtual machine that are running a specific virtual function) may also be used to identify the root cause of the cascade of errors 300.

Figure 4:
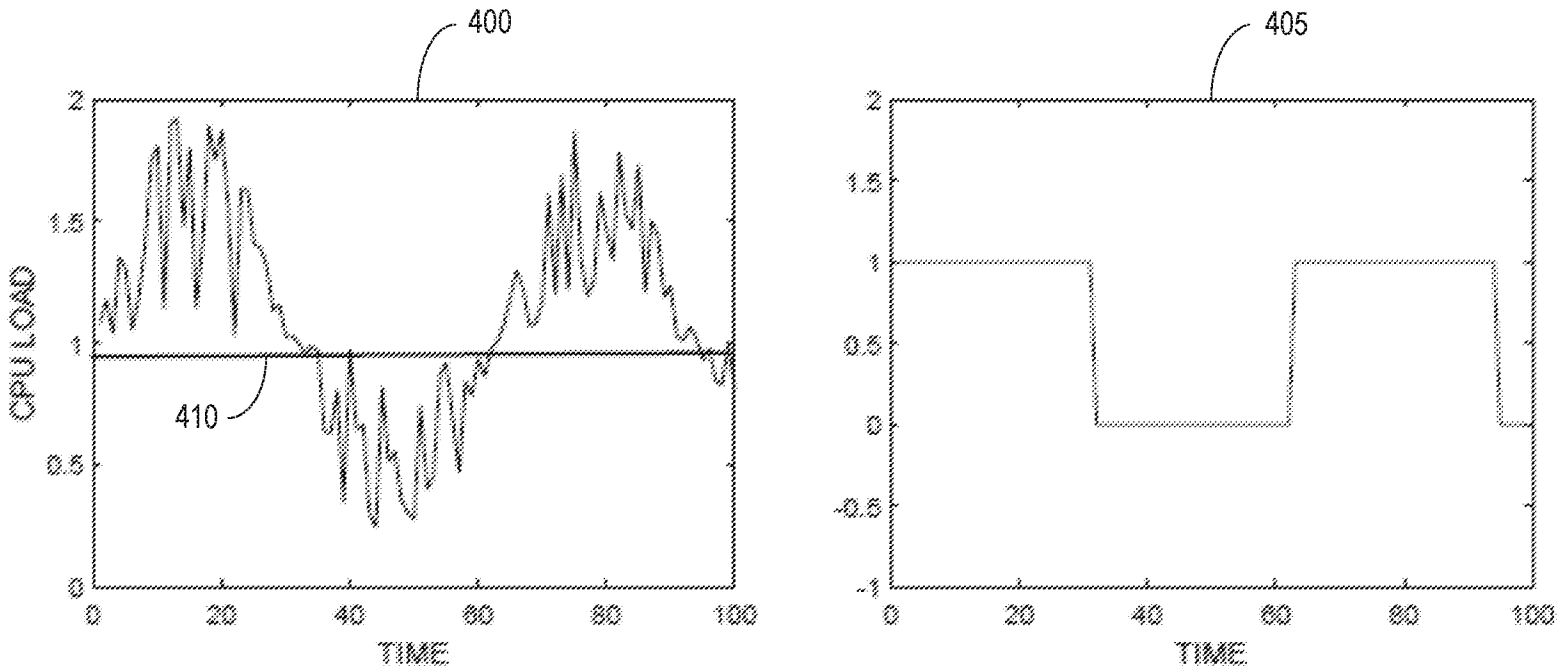
FIG. 4 illustrates a performance metric as a function of time and a corresponding time series of an alarm type indicated by the performance metric according to some embodiments.

FIG. 4 illustrates a performance metric 400 as a function of time and a corresponding time series 405 of an alarm type indicated by the performance metric 405 according to some embodiments. The time series 405 may be generated by an alarm monitor such as the alarm monitor 155 shown in FIG. 1 by monitoring the performance metric 405 collected by entities in the communication network 100 shown in FIG. 1. The performance metric 400 represents a CPU load on a CPU that may be implemented in a server. The performance metric 400 is compared to a threshold value 410 that represents an alarm condition due to a high CPU load. The time series 405 for the "high CPU load" alarm type is a binary series that takes on the value 1 when the alarm is active in the value 0 when the alarm is inactive.

The CPU load 400 exceeds the threshold 410 from a time of 0 to a time of approximately 35, falls below the threshold 410 from the time of approximately 35 to a time of approximately 60, and again rises above the threshold 410 from the time of approximately 60 to a time of approximately 95. The value of the time series 405 therefore switches between 1 (error condition) and 0 (no error condition) during the corresponding time intervals. The time series 405 may be represented as:

$$A^{\{q,r\}}=(a_1^{\{q,r\}}, \ldots, a_n^{\{q,r\}}) \tag{1}$$

In equation (1), the variable $a_i$ is a binary variable representing activation states of individual alarms over the time period $T=(t_1, \ldots, t_n)$, the variable q represents an alarm type, and the variable r represents a resource that generated the alarm. Although thresholding is used to convert the measured values of the performance metric 400 to the binary time series 405 in the illustrated embodiment, other techniques or criteria may be used to perform the conversion of the performance metric 400 to the binary time series 405.

The time series for alarms of different alarm types generated by different resources in a communication network such as the communication network 100 shown in FIG. 1 can be used to identify root causes of alarms. For example, an alarm monitor such as the alarm monitor 155 shown in FIG. 1 can access time series for alarms of different alarm types such as the time series shown in equation (1). The alarm monitor may use similarity measures such as correlations between the alarms in the alarm series for different alarm types to identify clusters of alarm types. For example, a pair of alarm types may form a cluster if a correlation between the time series for the two alarm types in the pair exceeds a threshold. For another example, if correlations between the alarm types are represented as a graph of nodes that represent alarm types connected by edges that are weighted by the strength of the correlation between the alarm types or other similarity measure, decomposition of the graph may be used to define the clusters by removing edges in the graph that have weights that are below a threshold. For yet another example, a one-shot technique may define clusters that include different numbers of alarm types by considering weights associated with all of the edges connected to each node in the graph and selecting clusters of nodes that are interconnected by edges having relatively large weights.

The alarm monitor may determine causal connections between alarm types in the clusters based on temporal proximity and ordering of the alarm types in the clusters. For example, the alarm monitor may determine that a first alarm type in a cluster causes a second alarm type in the cluster if alarms of the first alarm type overlap alarms of the second alarm type and precede the alarms of the second alarm type in the time series. The alarm monitor may then store causality templates representative of the causal connections between the alarm types in one or more clusters.

Figure 5:
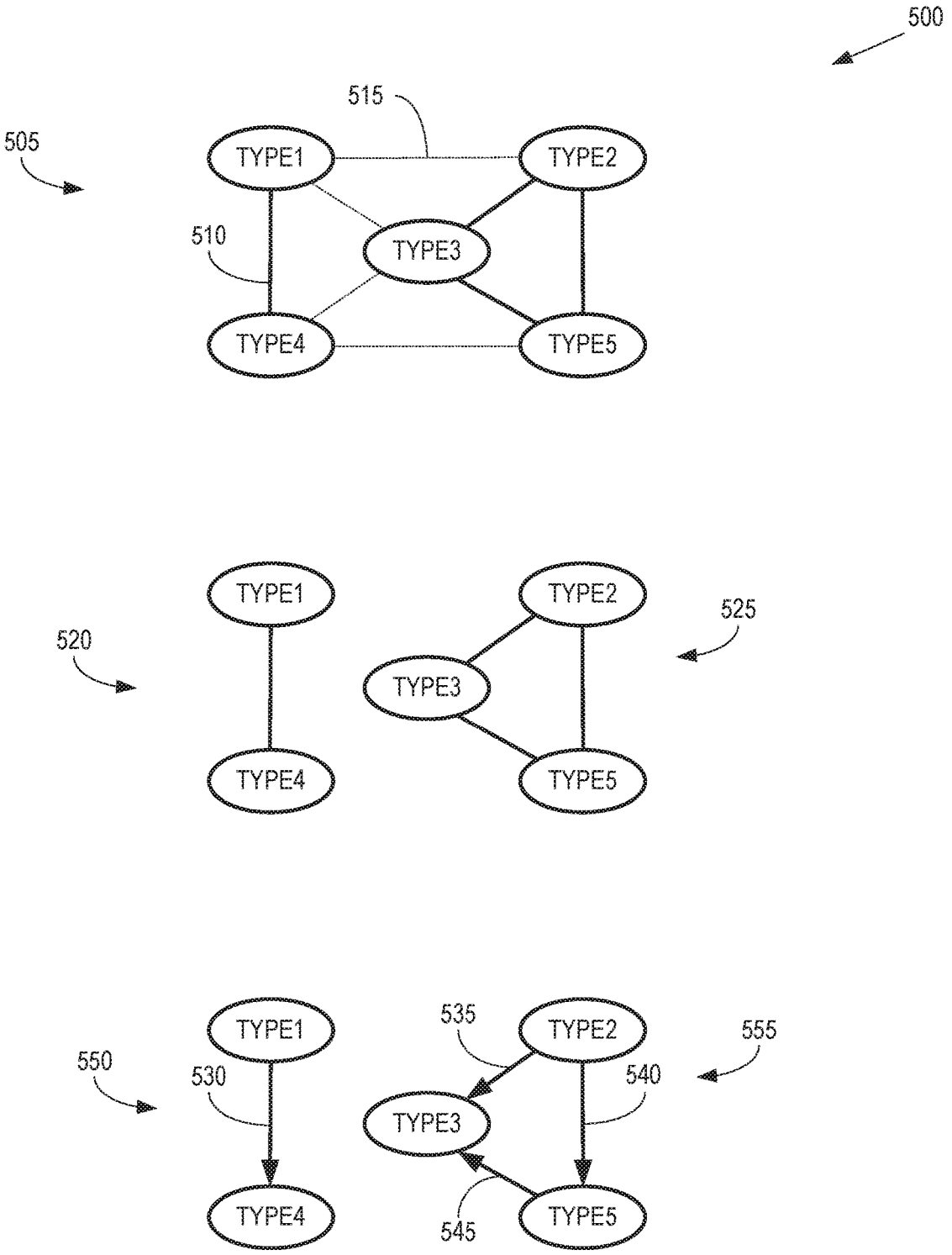
FIG. 5 is a diagram of a process of defining clusters of alarm types and the causal connections between the alarm types within the clusters according to some embodiments.

FIG. 5 is a diagram of a process 500 of defining clusters of alarm types and the causal connections between the alarm types within the clusters according to some embodiments. The process 500 may be performed by some embodiments of the alarm monitor 155 shown in FIG. 1. In the illustrated embodiment, the alarm monitor accesses time series for five different types of alarms (TYPE1, TYPE2, TYPE3, TYPE4, TYPE5) that are produced in an NFV architecture such as the NFV architecture 200 shown in FIG. 2.

The different alarm types are represented as nodes in a graph 505. The alarm monitor uses a similarity measure to determine clusters of the nodes. Some embodiments of the alarm monitor establish the degree of similarity by performing a correlation analysis on the time series for the different alarm types. For example, the alarm monitor may perform a Pearson correlation:

$$\rho(X, Y) = \frac{COV(X, Y)}{\sigma_X \sigma_Y} = \frac{E[(X-\mu_X)(Y-\mu_Y)]}{\sigma_X \sigma_Y} \tag{2}$$

where COV is a covariance matrix, σ is a standard deviation, μ is the mean, E[ ] is the expectation, and the variables X, Y correspond to values of the time series, e.g., as represented by equation (1). However, other correlations or similarity measures may be used instead of the Pearson correlation shown in equation (2). In some embodiments, the time series may be summed over all resources for each alarm type. For example, the summation-derived time series may be represented as:

$$A^{\{q,*\}}=\Sigma_r A^{\{q,r\}} \quad (3)$$

In equation (3), the summation is taken over all resources r that raised an alarm of alarm type q.

Edges in the graph 505 indicate non-zero correlations between the corresponding nodes. Weights may be assigned to the edges based on the strength of the correlations between the different alarm types connected by the edges in the graph 505. Some embodiments of the alarm monitor calculate a correlation matrix to determine the strength of correlations between the nodes that represent the different alarm types in the graph 505. For example, the correlation matrix P may be defined using equations (2) and (3) as:

$$p(q_1,q_2)=\rho(A^{\{q_1,*\}},A^{\{q_2,\}}) \quad (4)$$

The weights of the edges between the nodes are determined based on equation (4). Strong correlations that exceed a threshold correlation are indicated by solid lines 510 (only one indicated by a reference numeral in the interest of clarity) and weak correlations that are below the threshold correlation are indicated by dotted lines 515 (only one indicated by a reference numeral in the interest of clarity).

Clusters are determined based on the weights associated with the edges shown in the graph 505. For example, a pair of nodes for the alarm types TYPE1 and TYPE4 are strongly correlated and therefore form the cluster 520. For another example, decomposition of the graph 505 may be used to generate the clusters 520, 525 by removing the edges 515 that have weights below a threshold. For yet another example, a one-shot method may be used to form clusters that include multiple nodes that are strongly correlated with each other. For example, the nodes for the alarm types TYPE2, TYPE3, and TYPE5 are correlated with each other and are therefore considered part of the cluster 525. In some cases the cluster detection method may consider other optimization targets for recovering clusters in addition to considering only the pairwise weights on the edges in a sequential manner. Some embodiments of the alarm monitor may use other clustering algorithms to identify clusters of alarm types and generate graphs that are representative of clusters of the nodes.

Causal connections between the nodes in the clusters 520, 525 are determined based on temporal proximity and ordering of the alarm types in the clusters 520, 525. Some embodiments of the alarm monitor determine whether alarms of the different alarm types in each cluster temporally overlap with each other in their corresponding time series. The alarm monitor may also determine whether the alarms of one of the alarm types precedes the alarms of the other alarm types in the corresponding time series. For example, the TYPE1 alarms overlap at least partially with the TYPE4 alarms in the cluster 520. The TYPE1 alarms also precede the TYPE4 alarms and so the alarm monitor determines that the causal connection is from the TYPE1 alarms to the TYPE4 alarms, as indicated by the arrow 530. However, other rules or algorithms may be used to determine causal connections between the nodes in the clusters 520, 525. The causal connections between the TYPE1 alarms and the TYPE4 alarms are indicated by a causality template such as the directed graph 550.

Logical relationships between the alarms can be determined on the basis of the directed graphs 550, 555 shown in FIG. 5. For example, the causal connections between the alarms of alarm types TYPE2, TYPE3, and TYPE5 are indicated by the arrows 535, 540, 545. The causal connections between the TYPE2 alarms, the TYPE3 alarms, and the TYPE5 alarms may also be indicated by a causality template such as the directed graph 555, which indicates that a TYPE2 alarm may cause a TYPE3 alarm and a TYPE5 alarm. The causal connections 535, 540 also indicate that both a TYPE2 alarm and a TYPE5 alarm are causally connected to a TYPE3 alarm. The logical relationships between the TYPE2, TYPE3, and TYPE5 alarms may therefore be represented using Boolean logic as TYPE2 AND TYPE5→TYPE3. Other Boolean logical relationships including OR, XOR, NAND, NOR, and the like may also be determined between alarms of different types based on the corresponding directed graphs.

The directed graphs 550, 555 may also be used to perform real-time root cause analysis in response to detecting alarms in an NFV architecture. For example, if the alarm monitor detects a series of alarms of TYPE4, the alarm monitor may compare the stored or previously determined causality templates to the current alarm state of the system. For example, the alarm monitor may determine that the system is also producing a series of alarms of TYPE1, and the directed graph 550 may therefore indicate that the TYPE1 alarms indicate the root cause of the alarms and the TYPE4 alarms are produced in response to the root cause that generated the TYPE1 alarms. In some embodiments, dependency information such as information indicating the identities of the entities in the NFV architecture that generate alarms of the different types may also be used to identify the root cause of the cascade of errors 300. For example, if an alarm of TYPE2 is detected concurrently with alarms of TYPE3 and TYPE5, and dependency information indicates that the TYPE2 alarm occurred on a first virtual network function, the TYPE3 alarm occurred on a first virtual machine, and the TYPE5 alarm occurred on a first server, then the root cause may be determined only on the basis of templates that include alarm types that occur on the same combination of a virtual network function, a virtual machine, and a server. Templates that include one or more of the detected alarm types but do not indicate alarms occurring on the same combination of entities are not considered when determining the root cause.

Figure 6:
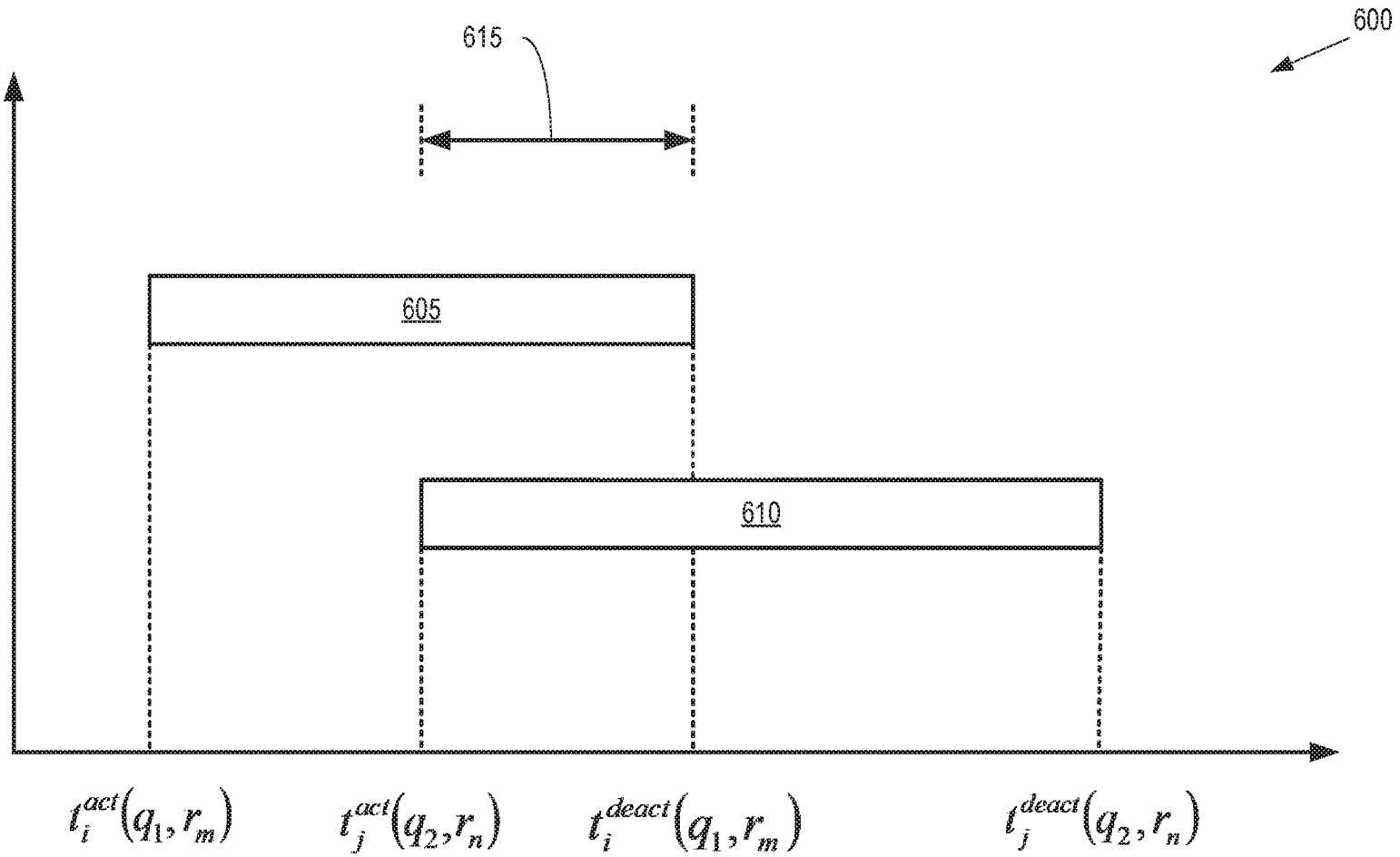
FIG. 6 is a diagram of alarms in two time series for two different alarm types according to some embodiments.

FIG. 6 is a diagram 600 of alarms in two time series for two different alarm types according to some embodiments. The alarms 605, 610 may be detected in some embodiments of a communication network such as the communication network 100 shown in FIG. 1. In the illustrated embodiment, the alarms 605, 610 are part of a cluster that may be determined based upon the strength of correlations between the time series including the alarms 605, 610. The first alarm 605 is part of a corresponding time series for an alarm type $q_1$. The first alarm 605 is raised by a resource $r_m$. The first alarm 605 is active for a time interval that begins at the activation time $t_1^{act}(q_1,r_m)$ and ends at the deactivation time $t_1^{deact}(q_1,r_m)$. The second alarm 610 is part of a corresponding time series for an alarm type $q_2$. The second alarm 610 is raised by a resource $r_n$. The second alarm 610 is active for a time interval that begins at the activation time $t_2^{act}(q_2,r_n)$ and ends at the deactivation time $t_2^{deact}(q_2,r_n)$. In some embodiments, an additional phase may be applied to either of the alarms 605, 610 to account for offsets between the activation times of the alarm 605, 610 before determining whether there is a correlation between the alarms 605, 610. The additional phase may shift one of the alarms 605 or 610 to the left or the right depending on the sign of the phase shift. The additional phase also modifies the activation or deactivation times for the subsequent temporal analysis.

A comparison of the activation times of the alarms 605, 610 indicates that the alarms 605, 610 overlap during the time interval 615. The alarm 605 precedes the alarm 610, as indicated by a comparison of their activation times. Thus, an alarm monitor may determine a causal connection between the alarms 605, 610 in which occurrence of the alarm 605 results in the subsequent occurrence of the alarm 610.

In some embodiments, a time proximity analysis can be performed on the basis of the activation and deactivation timestamps of alarms of different alarm types. For example, activation and deactivation time series may be defined as:

$$T^{act}(q,r)=t_1^{act}(q,r), \ldots ,t_k^{act}(q,r)$$

$$T^{deact}(q,r)=t_1^{deact}(q,r), \ldots ,t_k^{deact}(q,r)$$

A temporal condition may be checked for each pair of alarm events of the different alarm types ($q_1$, $q_2$), for example:

Given two alarm events $[t_i^{act}(q_1,r_m),t_i^{deact}(q_1,r_m)]$ and $[t_j^{act}(q_2,r_n),t_j^{deact}(q_2,r_n)]$, if $t_i^{act}(q_1,r_m)\leq t_j^{act}(q_2,r_n)$ and $t_j^{deact}(q_2,r_n)\leq t_i^{deact}(q_1,r_m)$, then the alarm type $q_1$ is suspected as a cause of the alarm type $q_2$. Condition 1.

Condition 1 may be tested for alarms in the time series for the different alarm types to determine the causality connection between the alarm types. For example, if $I(q_1, q_2)$ is an indicator function that indicates when Condition 1 has been fulfilled, causality may be determined based on the condition, for example:

Given two alarm types $(q_1,q_2)$, if $\Sigma_{(i,j)}I_{(i,j)}(q_1,q_2)>\Sigma_{(i,j)}I_{(i,j)}(q_2,q_1)$, where $i$ and $j$ correspond to alarms having alarm types $q1$ and $q2$, respectively, then we determine a causality relation of $q_1\rightarrow q_2$. Condition 2.

In some embodiments, a threshold may be applied to the indicator function summation to capture only significant amounts of condition fulfillment events. However, other conditions may be used to determine the temporal proximity or the ordering of the alarm types.

Figure 7:
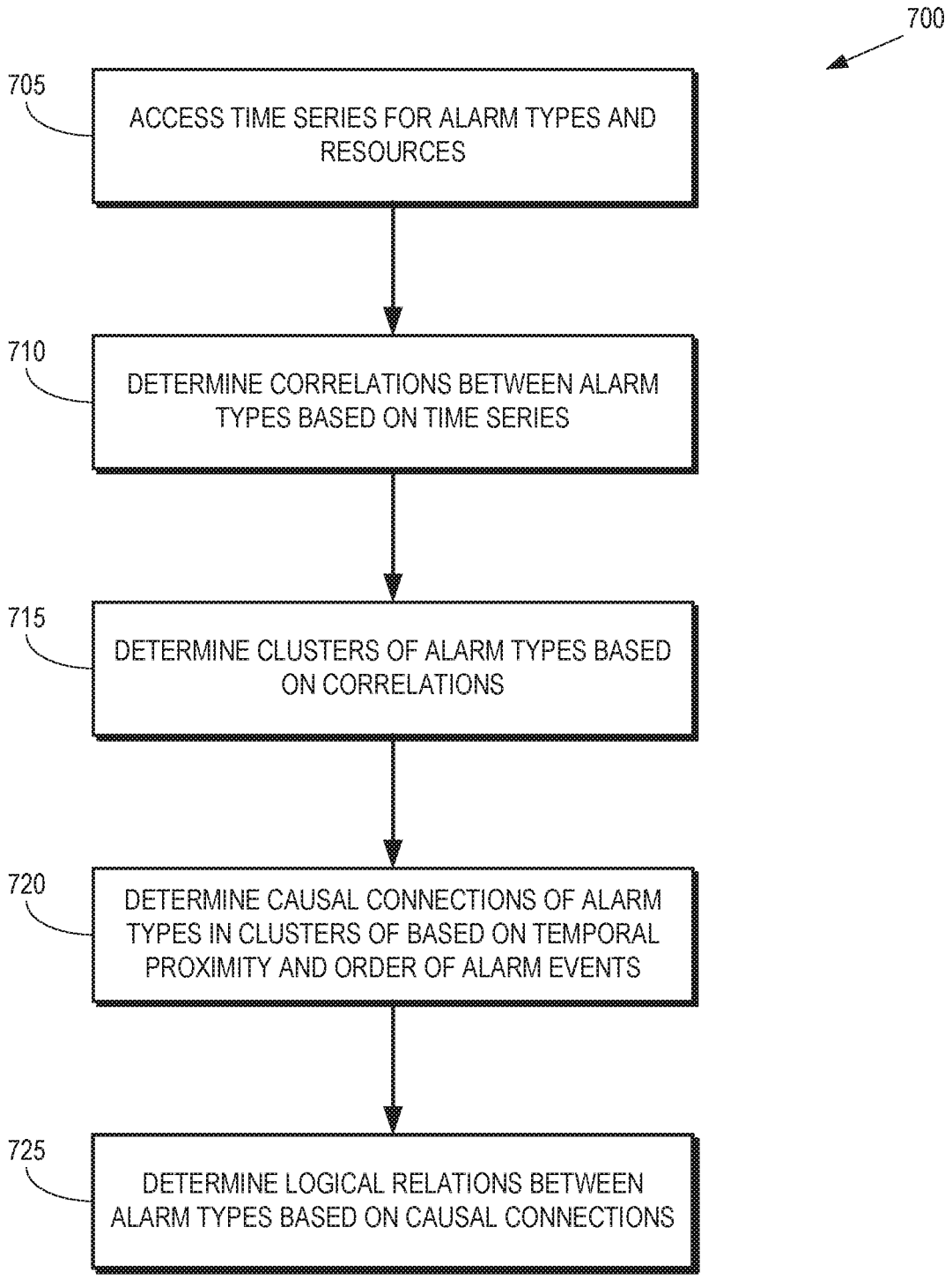
FIG. 7 is a flow diagram of a method for determining causal connections and logical relations between alarm types according to some embodiments.

FIG. 7 is a flow diagram of a method 700 for determining causal connections and logical relations between alarm types according to some embodiments. The method 700 may be implemented in some embodiments of the alarm monitor 155 shown in FIG. 1. At block 705, the alarm monitor accesses a set of time series that includes time series of alarms for different alarm types that may be raised by different resources, including hardware resources and virtual resources of a communication network that implements an NFV architecture. At block 710, the alarm monitor determines correlations between the alarm types by correlating alarms in the time series for the different alarm types. At block 715, the alarm monitor determines clusters of alarm types based on the correlations. For example, pairs of alarm types that have a correlation above a threshold may be added to a cluster. At block 720, the alarm monitor determines causal connections of the alarm types in the clusters based on temporal proximity and an order of alarm events in the time series. For example, the alarm monitor may determine that an alarm of a first type causally precedes an alarm of a second type in response to alarms of the first type overlapping and preceding alarms of the second type in corresponding time series. At block 725, the alarm monitor determines logical relations between the alarm types based on the causal connections.

Figure 8:
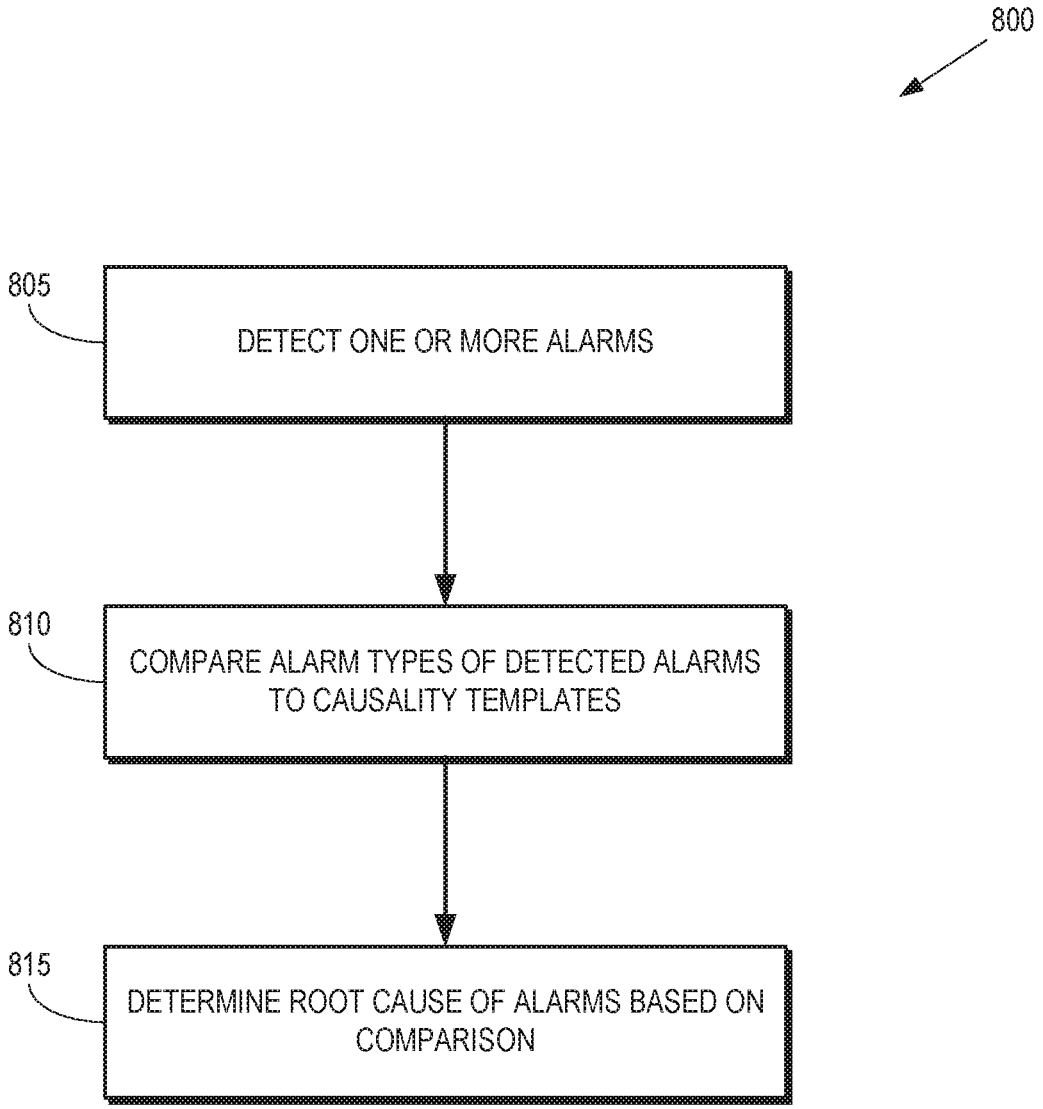
FIG. 8 is a flow diagram of a method for performing real-time detection of root causes of alarms according to some embodiments.

FIG. 8 is a flow diagram of a method 800 for performing real-time detection of root causes of alarms according to some embodiments. The method 800 may be implemented in some embodiments of the alarm monitor 155 shown in FIG. 1. At block 805, the alarm monitor detects one or more alarms that may be generated by hardware resources or virtual resources in a communication network that implements an NFV architecture such as the communication network 100 shown in FIG. 1. At block 810, the alert monitor compares the alarm types of the detected alarms to one or more causality templates that are determined based on correlations of time series of alarms of different types. At block 815, the alert monitor determines a root cause of the one or more alarms based on the comparison of the alarm types. For example, if the temporal proximity and ordering of one or more alarms matches (within a tolerance) the pattern indicated by a causality template that has a known root cause, the root cause of the detected one or more alarms may be determined to be the root cause associated with the causality template. As discussed herein, dependency information may also be used to determine the root cause of alarms by allowing the alert monitor to exclude causality templates that do not correspond to the resources types (e.g. server, virtual machine) that generated the alarms, as indicated in the dependency information.

In some embodiments, certain aspects of the techniques described above may be implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

A computer readable storage medium may include any storage medium, or combination of storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments.

However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A method comprising:

accessing a plurality of time series of alarms of a plurality of alarm types in response to the alarms in the plurality of time series being generated due to faults or failures in resources of a network function virtualization (NFV) system;

identifying clusters of the plurality of alarm types based on similarities between the plurality of time series;

determining causal connections between alarm types in the clusters based on temporal proximity and ordering of the alarm types in the clusters, wherein the casual connections indicate that alarms of a first alarm type caused alarms of a second alarm type; and storing at least one causality template representative of the causal connections.

2. The method of claim 1, wherein the resources of the NFV system comprise at least one of computing hardware, storage hardware, network hardware, virtual functions, a virtual machine, virtual storage, and a virtual network.

3. The method of claim 1, wherein identifying the clusters of the plurality of alarm types comprises identifying the clusters based on at least one of strengths of similarities between the plurality of alarm types and numbers of alarm types that are correlated with each other.

4. The method of claim 1, wherein accessing the plurality of time series of alarms comprises converting time-dependent measurements of a plurality of parameters into a plurality of binary time series that indicate activation and deactivation times of the alarms.

5. The method of claim 1, wherein determining the causal connections between the alarm types in the clusters comprises:

determining whether the alarms of the first alarm type temporally overlap with the alarms of the second alarm type in the corresponding time series; and determining whether the alarms of the first alarm type are activated before the alarms of the second alarm type in the corresponding time series.

6. The method of claim 5, wherein determining the causal connection between the first alarm type and the second alarm type comprises determining that the first alarm type causes the second alarm type if alarms of the first alarm type temporally overlap with alarms of the second alarm type and the alarms of the first alarm type are activated before the alarms of the second alarm type.

7. The method of claim 4, wherein determining whether the alarms of the first alarm type triggers the alarms of the second alarm type comprises applying a phase shift to the alarms of the second alarm type prior to identifying the clusters, determining whether the time series of alarms of the first alarm type correlates with the phase-shifted times series of alarms of the second alarm type, and checking for overlap between the time series of alarms of the first alarm type and the phase-shifted time series of alarms of the second alarm type.

8. The method of claim 1, further comprising:

determining logical relationships between the plurality of alarm types based on the causal connections.

9. The method of claim 1, further comprising:

detecting a current alarm; and determining a root cause of the current alarm based on the at least one causality template.

10. An apparatus comprising:

a processor configured to access a plurality of time series of alarms of a plurality of alarm types an response to the alarms in the plurality of time series being generated due to faults or failures in resources of a network function virtualization (NFV) system, identify clusters of the plurality of alarm types based on correlations between the plurality of time series, and determine causal connections between alarm types in the clusters based on temporal proximity and ordering of the alarm types in the clusters, wherein the causal connections indicate that alarms of a first alarm type caused alarms of a second alarm type; and a memory configured to store at least one causality template representative of the causal connections.

11. The apparatus of claim 10, wherein the resources of the NFV system comprise at least one of computing hardware, storage hardware, network hardware, virtual functions, a virtual machine, virtual storage, and a virtual network.

12. The apparatus of claim 10, wherein the processor is configured to identify the clusters based on at least one of strengths of correlations between the plurality of alarm types and numbers of alarm types that are correlated with each other.

13. The apparatus of claim 10, wherein the processor is configured to convert time-dependent measurements of a plurality of parameters into a plurality of binary time series that indicate activation and deactivation times of the alarms.

14. The apparatus of claim 10, wherein the processor is configured to determine whether the alarms of the first alarm type temporally overlap with the alarms of the second alarm type in the corresponding time series and determine whether the alarms of the first alarm type are activated before the alarms of the second alarm type in the corresponding time series.

15. The apparatus of claim 14, wherein the processor is configured to determine that the first alarm type causes the second alarm type if the alarms of the first alarm type temporally overlaps with the alarms of the second alarm type and the alarms of the first type are activated before the alarms of the second alarm type.

16. The apparatus of claim 13, wherein the processor is configured to apply a phase shift to the alarms of the second alarm type prior to identifying the clusters, determine whether the time series of alarms of the first alarm type correlates with the phase-shifted times series of alarms of the second alarm type, and check for overlap between the time series of alarms of the first alarm type and the phase-shifted time series of alarms of the second alarm type.

17. The apparatus of claim 10, wherein the processor is configured to determine logical relationships between the plurality of alarm types based on the causal connections.

18. The apparatus of claim 10, wherein the processor is configured to detect a current alarm and determine a root cause of the current alarm based on at least one causality template.

19. The apparatus of claim 18, wherein the processor is configured to detect a current alarm and determine a root cause of the current alarm based on the at least one causality template and additional dependency information indicating resources associated with the alarms.

20. A non-transitory computer readable medium embodying a set of executable instructions, the set of executable instructions to manipulate a processor to:

access a plurality of time series of alarms of a plurality of alarm types in response to the alarms in the plurality of time series being generated due to faults or failures in resources of a network function virtualization (NFV) system;

identify clusters of the plurality of alarm types based on correlations between the plurality of time series;

determine causal connections between alarm types in the clusters based on temporal proximity and ordering of the alarm types in the clusters, wherein the casual connections indicate that alarms of a first alarm type caused alarms of a second alarm type; and store at least one causality template representative of the causal connections.

21. The non-transitory computer readable medium set forth in claim 20, wherein the processor is to:

detect a current alarm; and determine a root cause of the current alarm based on the at least one causality template.

* * * * *